US010538100B2

(12) United States Patent
Fujikake et al.

(10) Patent No.: US 10,538,100 B2
(45) Date of Patent: Jan. 21, 2020

(54) INK SUPPLYING APPARATUS, PRINTING APPARATUS USING THE SAME, AND INK SUPPLYING METHOD

(71) Applicant: CANON KABUSHIKI KAISHA, Tokyo (JP)

(72) Inventors: Akira Fujikake, Kawasaki (JP); Takaya Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/017,636

(22) Filed: Jun. 25, 2018

(65) Prior Publication Data

US 2019/0009564 A1 Jan. 10, 2019

(30) Foreign Application Priority Data

Jul. 5, 2017 (JP) ..... 2017-132262

(51) Int. Cl.
*B41J 2/18* (2006.01)

(52) U.S. Cl.
CPC ..... *B41J 2/18* (2013.01)

(58) Field of Classification Search
CPC ..... B41J 2/18
See application file for complete search history.

(56) References Cited

U.S. PATENT DOCUMENTS 8,596,768 B2 12/2013 Koike et al. ..... 347/85

FOREIGN PATENT DOCUMENTS

| | | |
|---|---|---|
| JP | 2008-238750 | 10/2008 |
| JP | 2012-000819 | 1/2012 |
| JP | 2012-183695 | 9/2012 |
| JP | 2014-111334 | 6/2014 |

OTHER PUBLICATIONS

GB Search and Examination Report dated Dec. 20, 2018 in counterpart GB Patent Application No. 1810363.0.

*Primary Examiner* — Lamson D Nguyen
(74) *Attorney, Agent, or Firm* — Venable LLP

(57) ABSTRACT

An apparatus connected to a printhead has two states and switches between them. In the first state, ink is circulated in a channel of supplying ink from a tank that reserves ink to respective print elements via a common supply fluid channel and a plurality of individual supply fluid channels, and collecting the ink from the respective print elements to the tank via a plurality of individual collection fluid channels and a common collection fluid channel. In the second state, the ink is circulated in a channel of supplying the ink from the tank to the respective print elements via the common collection fluid channel and the plurality of individual collection fluid channels, and collecting the ink from the respective print elements to the tank via the plurality of individual supply fluid channels and the common supply fluid channel.

14 Claims, 13 Drawing Sheets

INK SUPPLYING APPARATUS, PRINTING APPARATUS USING THE SAME, AND INK SUPPLYING METHOD

BACKGROUND OF THE INVENTION

Field of the Invention

The present invention relates to an ink supplying apparatus, a printing apparatus using the same, and an ink supplying method.

Description of the Related Art

Conventionally, a printing apparatus that performs printing in accordance with an inkjet method prints a high-quality image while maintaining its printhead in a satisfactory state and includes various mechanisms for using ink efficiently. As one type of such mechanisms, there is a mechanism that circulates ink inside the printhead.

For example, Japanese Patent Laid-Open No. 2012-183695 discloses an apparatus that includes a printhead with a plurality of ink orifices (nozzles) and a common liquid chamber communicating with these ink orifices. Two fluid channels connected to a sub tank are connected to this common liquid chamber, and ink circulates in this common liquid chamber. The apparatus connects the sub tank and the printhead by the two fluid channels of a forward channel and a return channel, and when filling the printhead with the ink, circulates the ink from a forward channel port of the sub tank to a return channel port of the sub tank via the printhead or circulates the ink in an opposite direction.

Then, when the apparatus fills the printhead with the ink for the first time, it removes any bubbles in a circulation channel by reversing the ink circulation direction in the printhead.

In an arrangement in which the ink circulates in the plurality of nozzles of the printhead, however, it is impossible to remove bubbles present in each nozzle with the apparatus available in the prior art.

Therefore, when the printhead is attached to the printing apparatus and filled with the ink, bubbles may still remain in the nozzles and be released the first time a printing operation is undertaken. As a result, the ink is not discharged because of bubble release, making it impossible to perform satisfactory printing.

SUMMARY OF THE INVENTION

Accordingly, the present invention is conceived as a response to the above-described disadvantages of the conventional art.

For example, an ink supplying apparatus, a printing apparatus using the apparatus, and an ink supplying method according to this invention are capable of removing bubbles from each of the nozzles of a printhead having an ink circulation mechanism.

According to one aspect of the present invention, there is provided an ink supplying apparatus that is connected to a printhead which includes a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly and supplies the ink to the printhead, the apparatus comprising: a tank configured to reserve the ink; and a switch unit configured to be able to switch between a first circulation state in which the ink is circulated in a first circulation channel of supplying the ink from the tank to the plurality of print elements via the common supply fluid channel and the plurality of individual supply fluid channels, and collecting the ink from the plurality of print elements to the tank via the plurality of individual collection fluid channels and the common collection fluid channel and a second circulation state in which the ink is circulated in a second circulation channel of supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel.

According to another aspect of the present invention, there is provided a printing apparatus comprising: an ink supplying apparatus that is connected to a printhead which includes a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly and supplies the ink to the printhead; a transfer member on which an image is formed by ink discharged by the printhead; and a transfer unit configured to transfer, to a print medium, the image formed on the transfer member, wherein the ink supplying apparatus comprises: a tank configured to reserve the ink; and a switch unit configured to be able to switch between a first circulation state in which the ink is circulated in a first circulation channel of supplying the ink from the tank to the plurality of print elements via the common supply fluid channel and the plurality of individual supply fluid channels, and collecting the ink from the plurality of print elements to the tank via the plurality of individual collection fluid channels and the common collection fluid channel and a second circulation state in which the ink is circulated in a second circulation channel of supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel.

According to still another aspect of the present invention, there is provided an ink supplying method in an ink supplying apparatus that is connected to a printhead which includes a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly and supplies the ink to the printhead, the method comprising: switching between a first circulation state in which the ink is circulated in a first circulation channel of supplying the ink from a tank configured to reserve the ink to the plurality of print elements via the common supply fluid channel and the plurality of individual supply fluid channels, and collecting the ink from the plurality of print elements to the tank via the plurality of individual collection fluid channels and the common collection fluid channel and a second circulation state in which the ink is circulated in a second circulation channel of supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel.

The invention is particularly advantageous since it is possible to properly remove a bubble from each nozzle of a printhead.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. Note that in each drawing, arrows X and Y indicate horizontal directions perpendicular to each other, and an arrow Z indicates a vertical (up/down) direction.

Description of Terms

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (also referred to as a "liquid" hereinafter) should be broadly interpreted to be similar to the definition of "print" described above. That is, "ink" includes any liquid which, when applied onto a print medium, can form images, figures, patterns, and the like, can process the print medium, and can process ink. The processing of ink includes, for example, solidifying or insolubilizing a coloring agent contained in ink applied to the print medium. Note that this invention is not limited to any specific ink component, however, it is assumed that this embodiment uses water-based ink including water, resin, and pigment serving as a coloring material.

Further, a "print element (or nozzle)" generically means an ink orifice or a liquid channel communicating with it, and an element for generating energy used to discharge ink, unless otherwise specified.

An "element substrate" for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
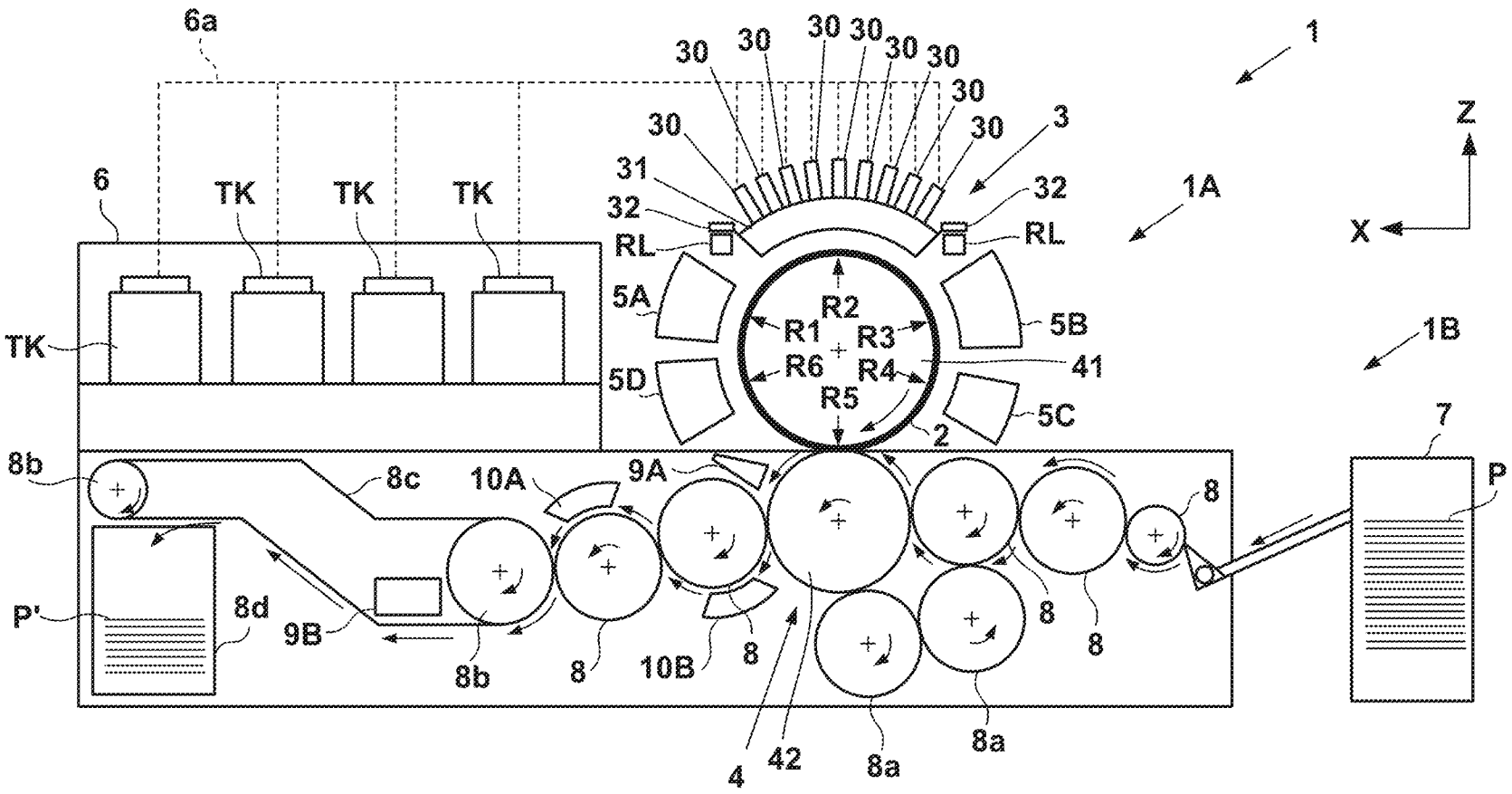
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5D, and a supply unit 6.

<Print Unit>

Figure 2:
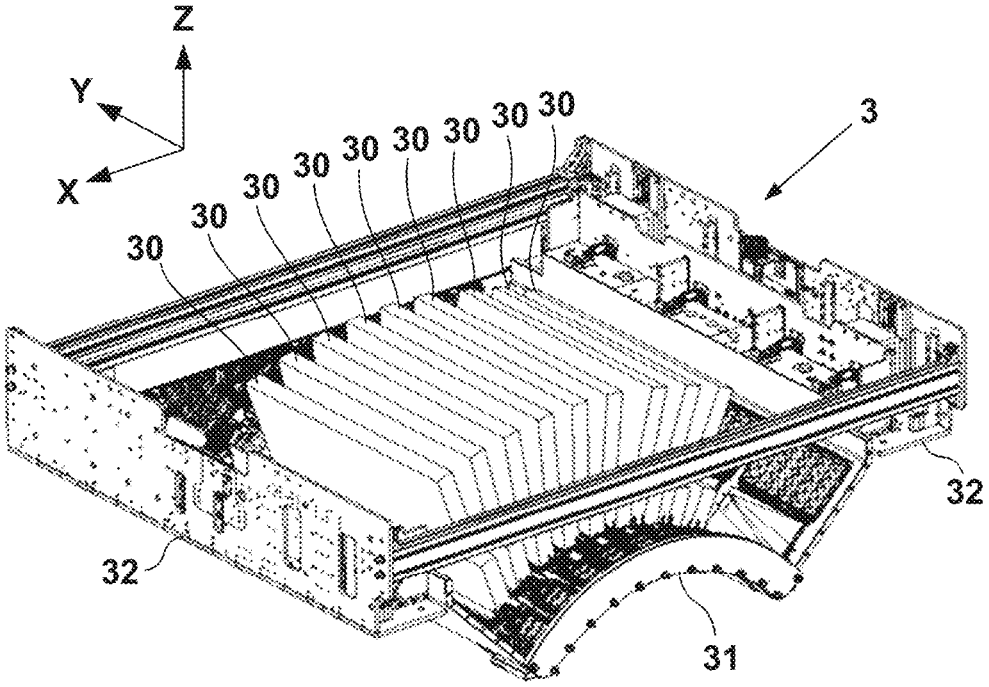
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in the ink with an electrothermal transducer and forming a bubble, an element that discharges ink by an electromechanical transducer (piezoelectric element), an element that discharges ink by using static electricity, or the like can be used as the discharge element. A discharge element that uses an electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge a plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
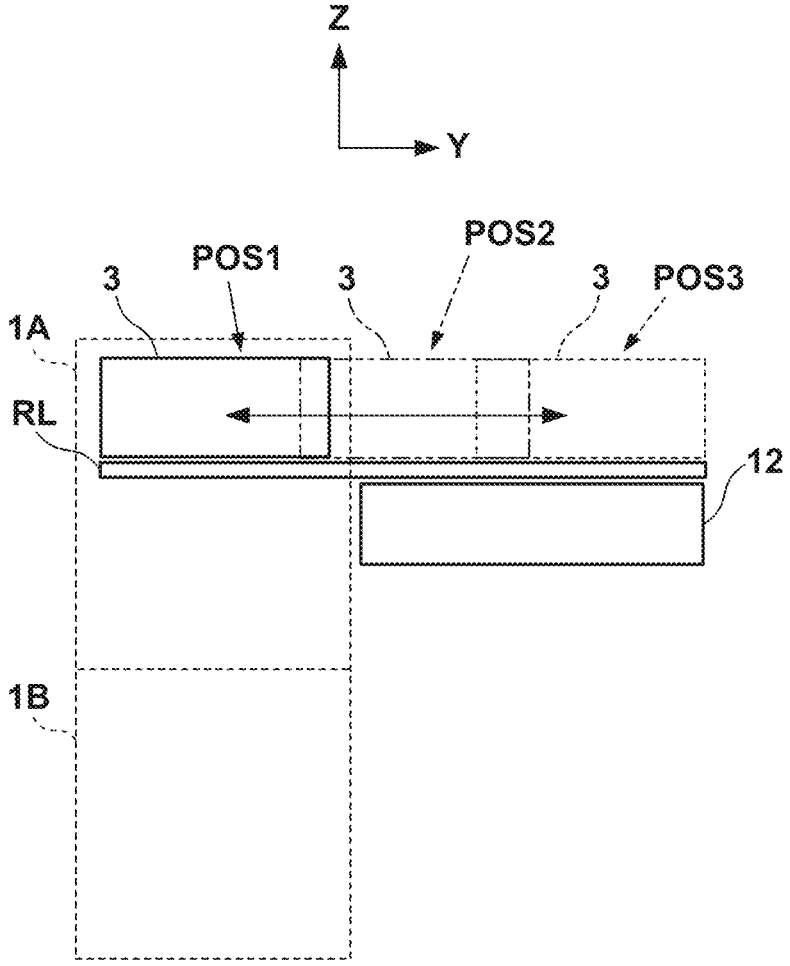
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock.

The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

Note that an ink circulation mechanism between the printhead 30 and a buffer tank of the reservoir TK will be described in detail later.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
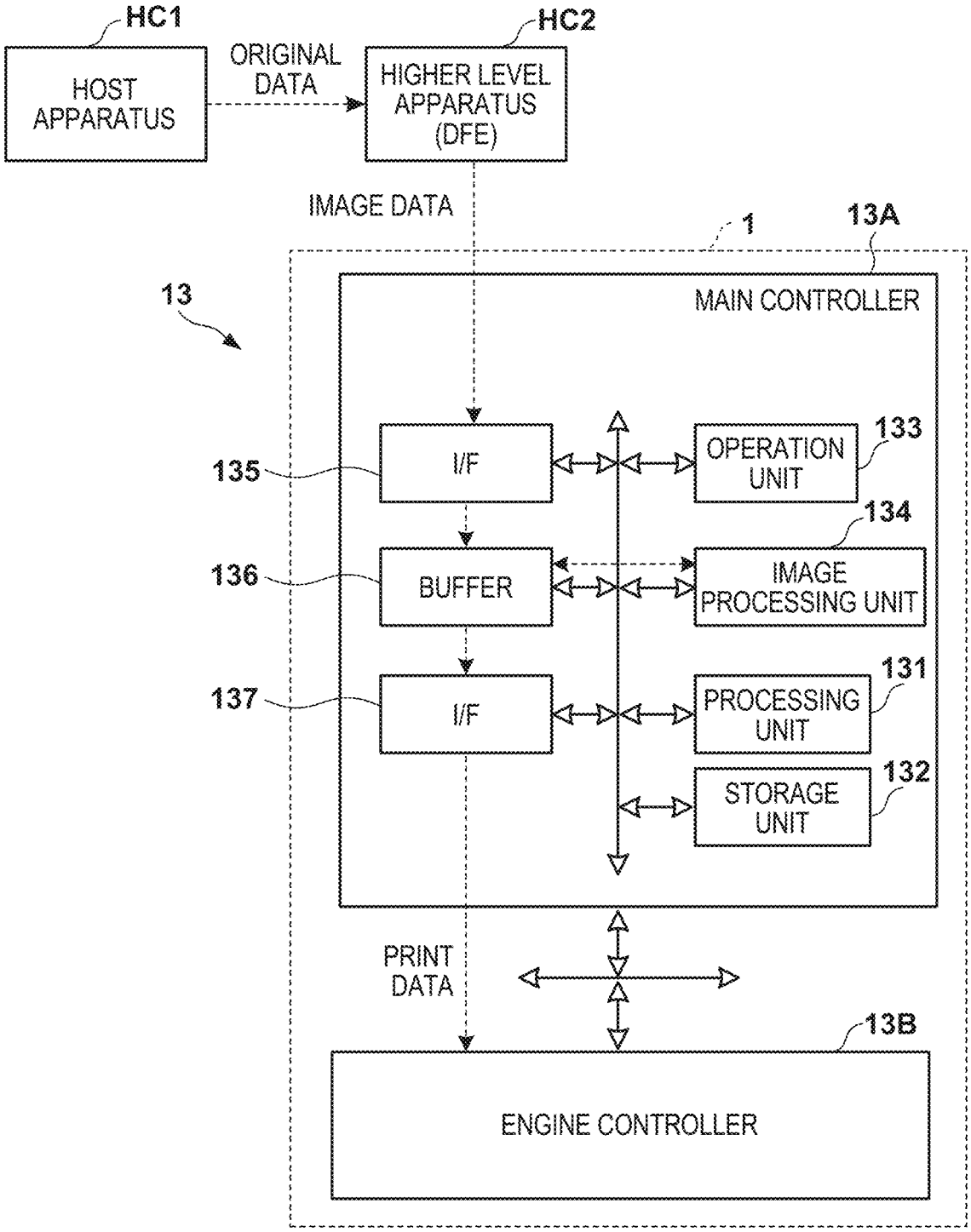
FIG. 4 is a block diagram showing a control system of the printing system in FIG. 1.
Figure 5:
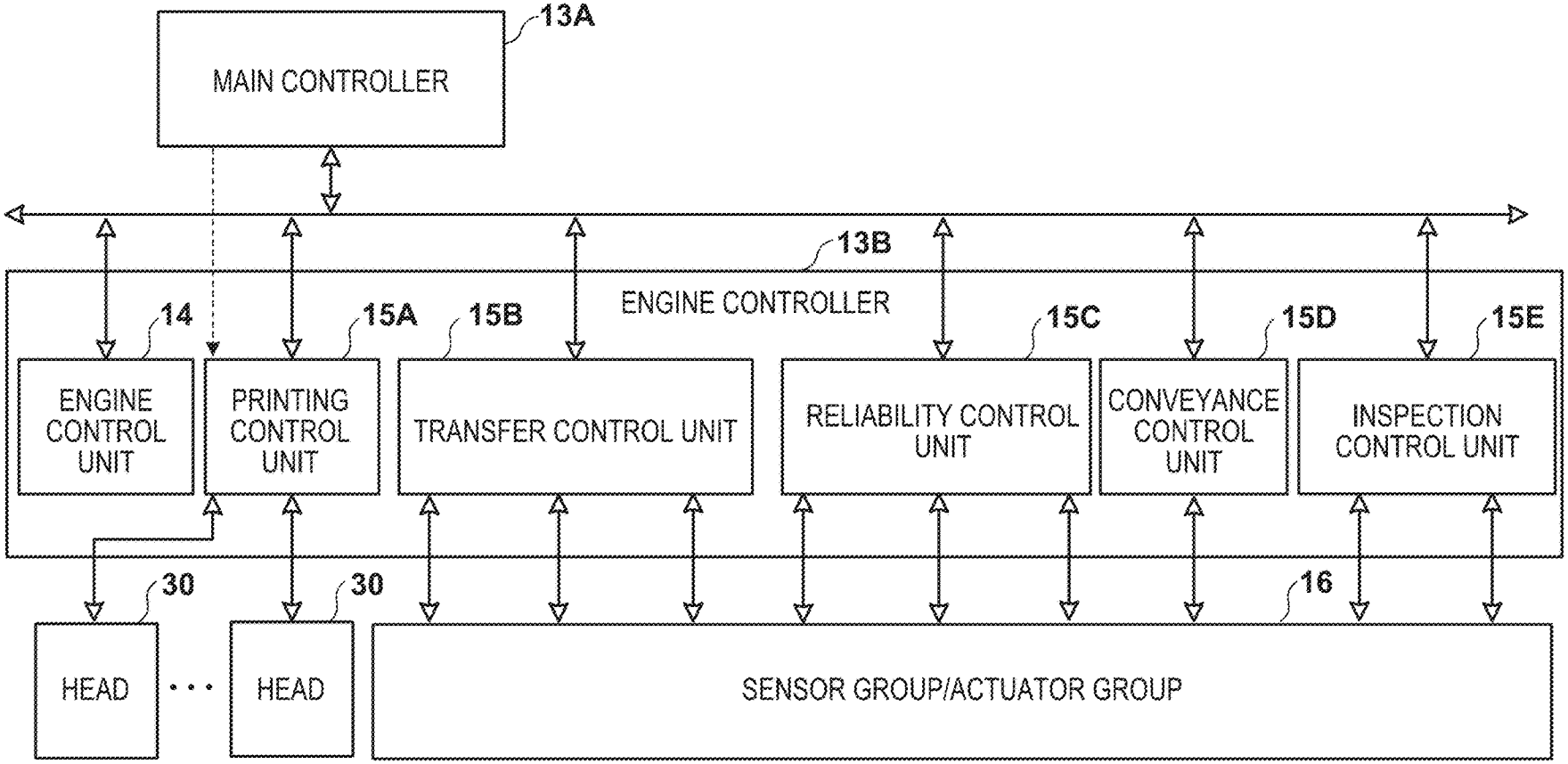
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes an engine control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
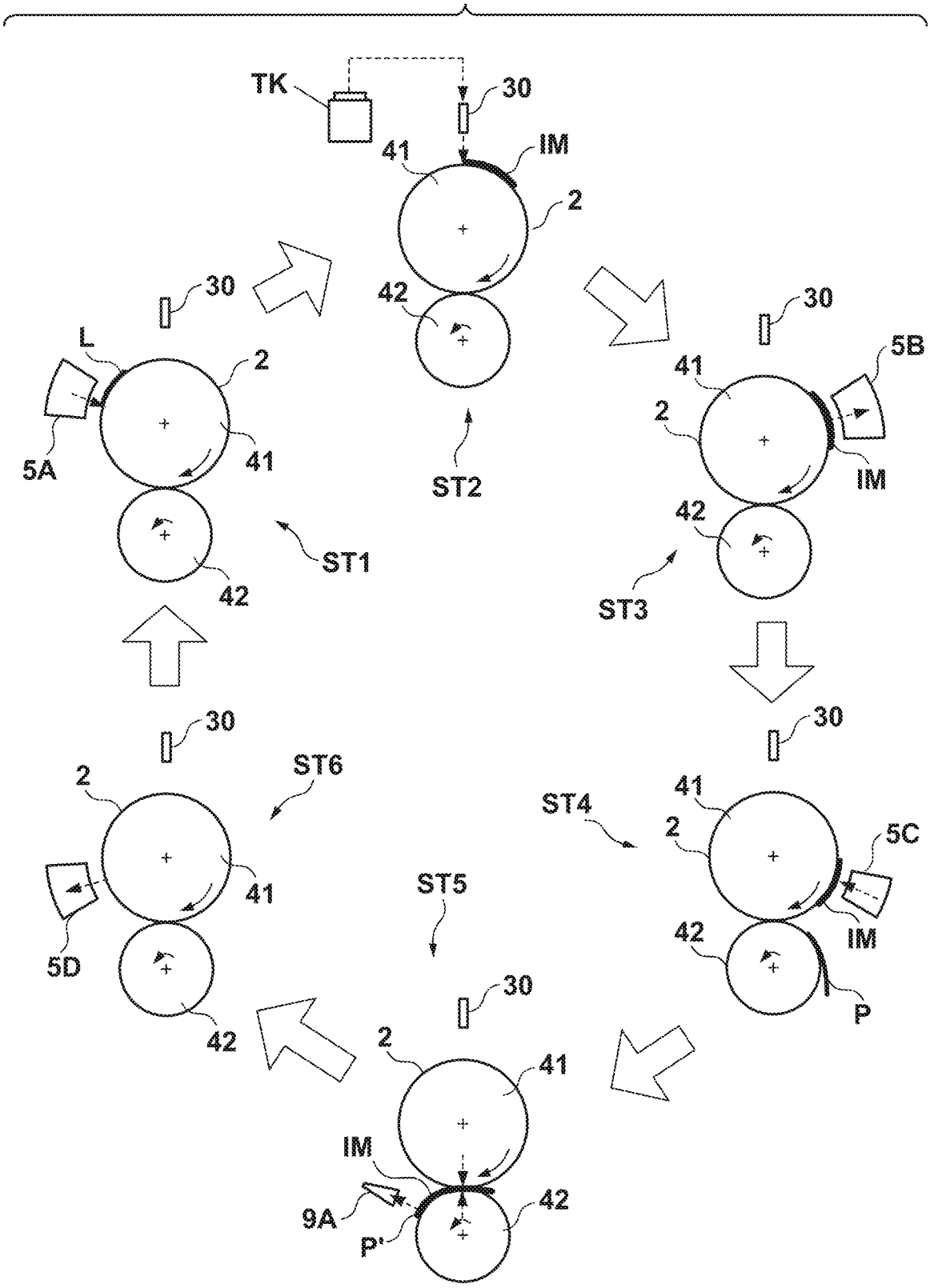
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
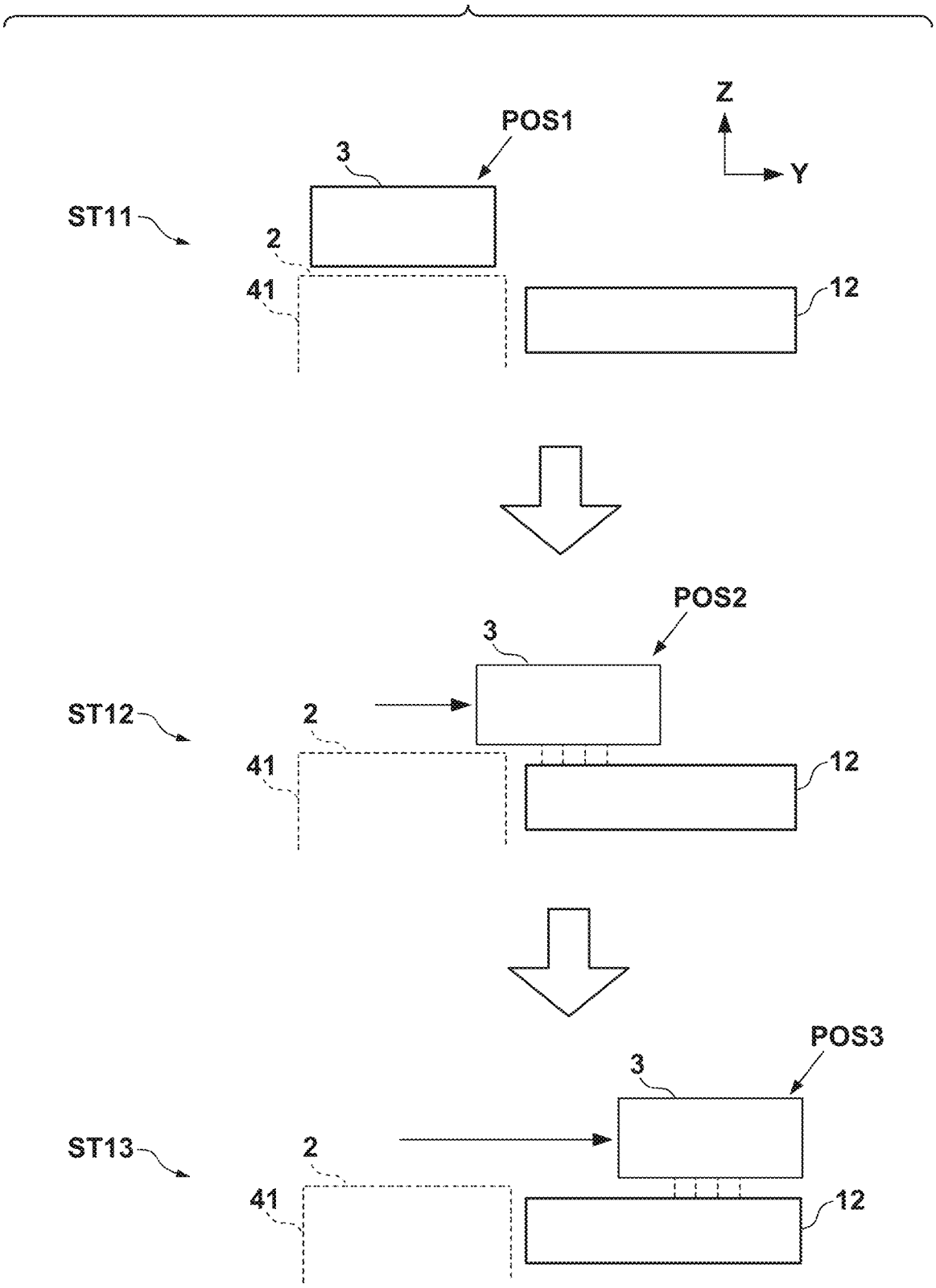
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

An ink circulation mechanism between the printhead 30 and an ink tank in the printing system having the above arrangement will be described next.

<Detailed Description of Ink Circulation Mechanism>

Figure 8A:
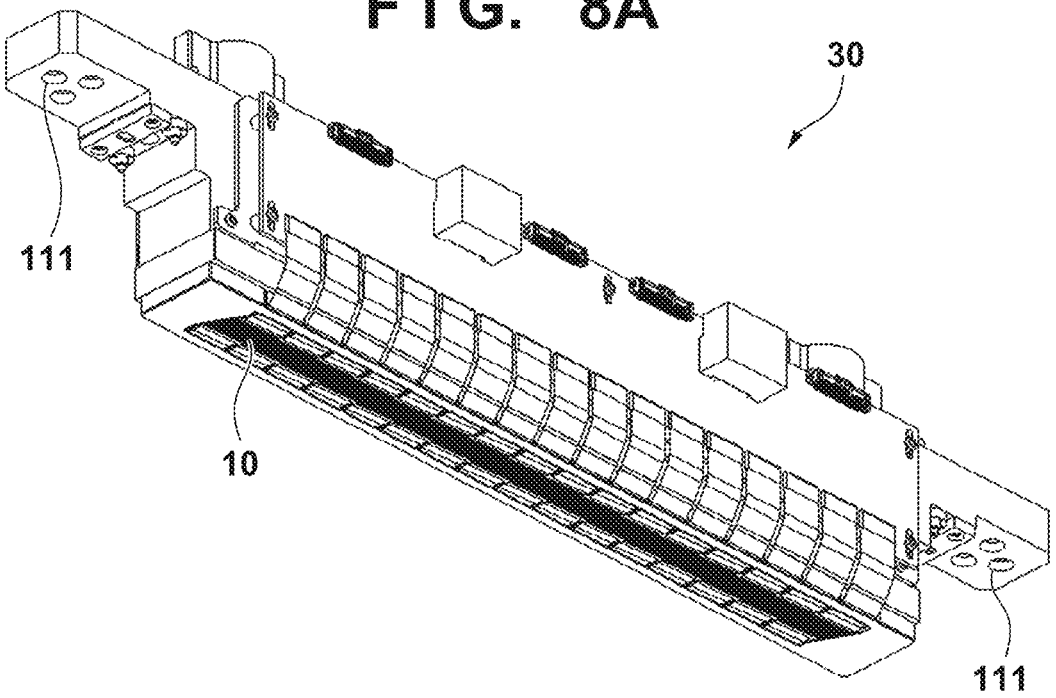
FIGS. 8A and 8B are perspective views each showing the arrangement of the printhead.
Figure 8B:
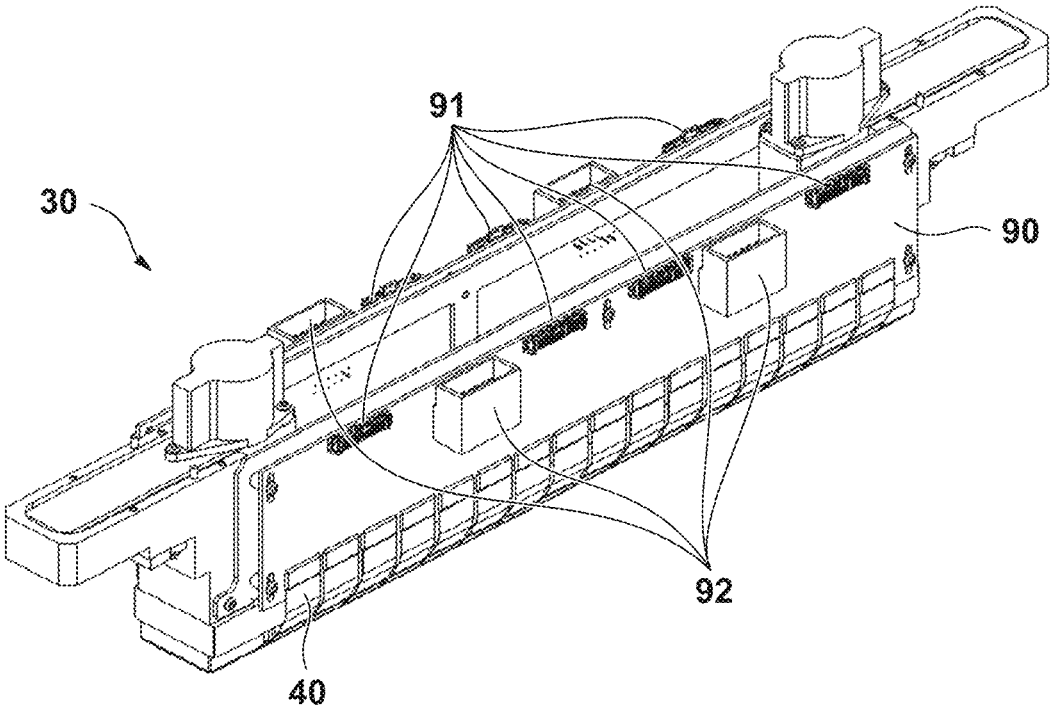

Concerning Detailed Arrangement of Printhead (FIGS. 8A and 8B)

FIGS. 8A and 8B are perspective views each showing the arrangement of the printhead 30.

FIG. 8A is the perspective view showing the printhead 30 when viewed from an obliquely downward direction. FIG. 8B is the perspective view showing the printhead 30 when viewed from an obliquely upward direction.

The printhead 30 is a full-line printhead that arrays fifteen element substrates 10 each capable of discharging one-color ink on a line (arranges them in line) and has a print width corresponding to the width of a print medium.

As shown in FIG. 8A, connection portions 111 provided in two end portions of the printhead 30 are connected to an ink supplying mechanism of the printing apparatus. Consequently, ink is supplied from the ink supplying mechanism to the printhead 30, and the ink that has passed through the printhead 30 is collected to the ink supplying mechanism. Thus, the ink can circulate via a channel of the ink supplying mechanism and a channel of the printhead 30.

As shown in FIG. 8B, the printhead 30 includes signal input terminals 91 electrically connected to the respective element substrates 10 and flexible wiring substrates 40 via an electric wiring substrate 90, and electric supply terminals 92. The signal input terminals 91 and the electric supply terminals 92 are electrically connected to the printing control unit 15A of the printing apparatus, and supply driving signals and power needed for discharge, respectively, to the element substrates 10. It is possible to reduce the number of signal input terminals 91 and electric supply terminals 92 as compared with the number of element substrates 10 by aggregating wirings with an electric circuit in the electric wiring substrate 90. This can reduce the number of electrical connection portions that need to be detached when the printhead 30 is attached to the print unit 3, or the printhead 30 is replaced.

Figure 9A:
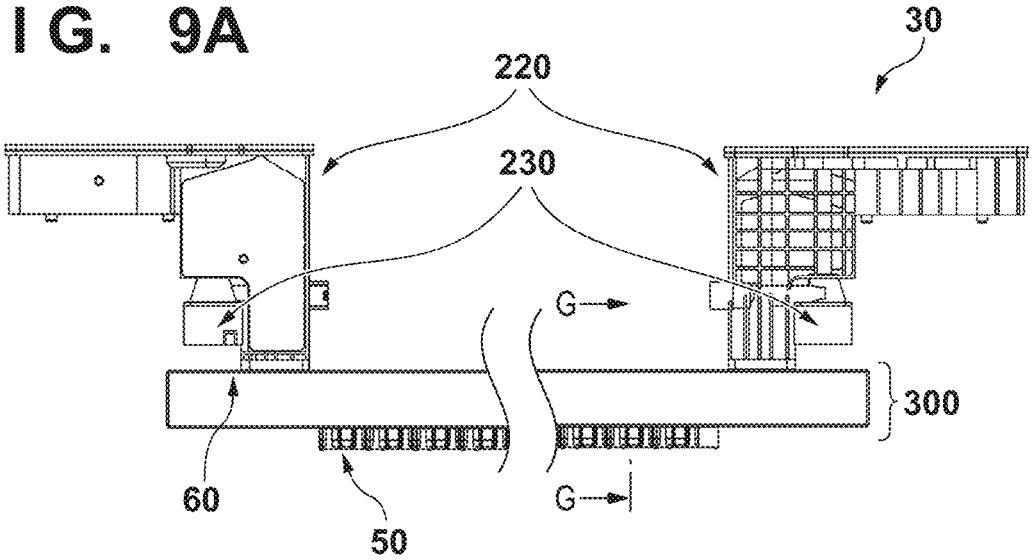
FIGS. 9A to 9C are views each for explaining a mechanism in which ink circulates in the printhead.
Figure 9B:
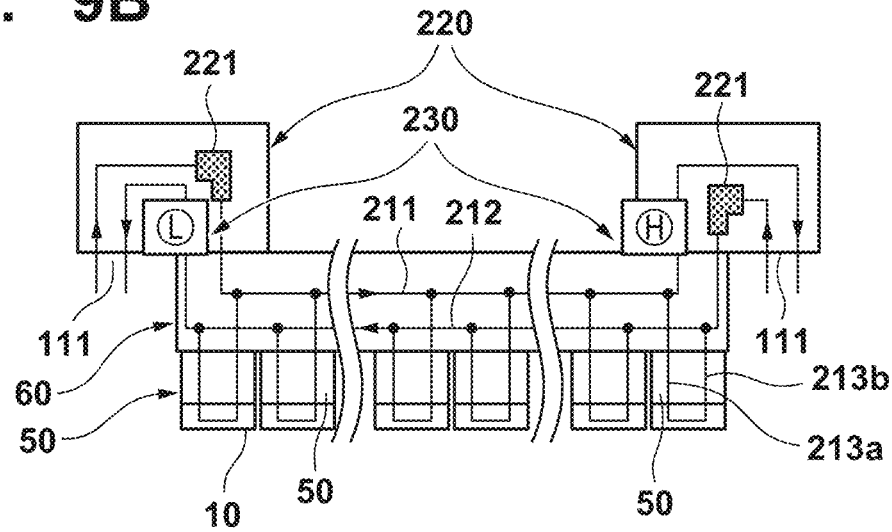
Figure 9C:
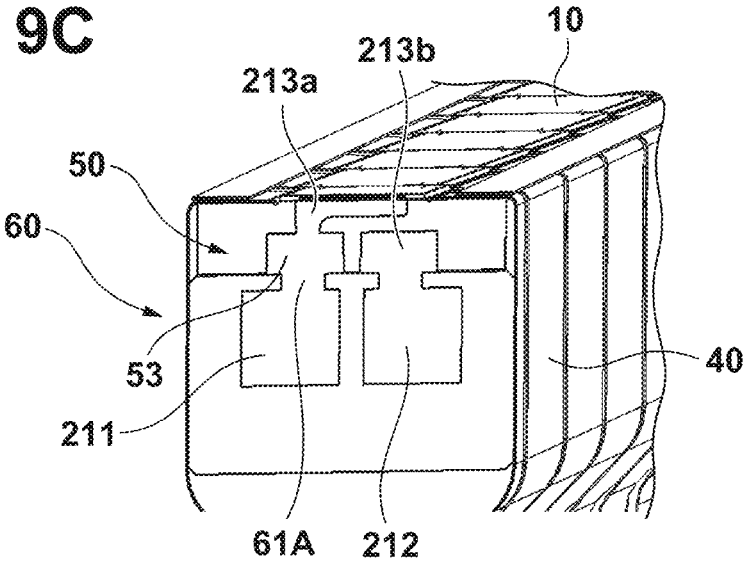

Concerning Ink Circulation Channel of Printhead (FIGS. 9A to 9C)

FIGS. 9A to 9C are views each for explaining a mechanism in which ink circulates in the printhead.

FIG. 9A is a side view showing the printhead 30 that includes a liquid discharge unit 300, liquid supplying units 220, and negative pressure control units 230. FIG. 9B is a schematic view showing a liquid flow. FIG. 9C is a perspective view showing a section taken along a line portion G-G of FIG. 9A.

As shown in FIG. 9A, the negative pressure control units 230 are formed integrally below the liquid supplying units 220. A fluid channel member 60 and other fluid channel members 50 below the fluid channel member 60 are attached to the liquid supplying unit 220. These two kinds of fluid channel members 50 and 60 form a part of the liquid discharge unit 300. Furthermore, as shown in FIG. 9B, the connection portions 111 and filters 221 are provided in the liquid supplying units 220. With this arrangement, a distance between the negative pressure control units 230 and the element substrates 10 in a height direction becomes short.

A water head difference between the negative pressure control units 230 and a surface where ink orifices are formed becomes relatively small, making it possible to suitably cope with the print unit 3 in which the respective printheads 30 have different tilt angles as shown in FIGS. 1 and 2. This is because the water head difference can be made smaller, making it possible to reduce a difference between negative pressures applied to the ink orifices of the respective element substrates even if the plurality of printheads 30 are used at the different tilt angles. It is also preferable that a flow resistance between the negative pressure control units 230 and the element substrates 10 is decreased by decreasing a distance from the negative pressure control units 230 to the element substrates 10, and a pressure loss difference caused by a change in flow rate of the liquid (ink) also becomes smaller, making it possible to perform stable negative pressure control.

Furthermore, FIG. 9B shows an actual ink flow inside the printhead 30. A pair of common supply fluid channel 211 and common collection fluid channel 212 extending in the longitudinal direction of the printhead 30 are provided in the elongated fluid channel member 60. The common supply fluid channel 211 and the common collection fluid channel 212 are arranged such that the liquid (ink) flows in a direction in which the liquid flows are opposite to each other, and the filters 221 are provided on upstream sides of respective fluid channels to trap foreign substances entered from the connection portions 111 and the like.

It is preferable that a temperature gradient in the longitudinal direction in the printhead 30 is reduced by thus causing the liquid to flow in the direction in which flows in the common supply fluid channel 211 and the common collection fluid channel 212 are opposite to each other.

The negative pressure control units 230 are connected on the downstream sides of the common supply fluid channel 211 and common collection fluid channel 212. There are branch portions to a plurality of individual supply fluid channels 213*a* midway along the common supply fluid channel 211 and branch portions to a plurality of individual collection fluid channels 213*b* midway along the common collection fluid channel 212. The individual supply fluid channels 213*a* and the individual collection fluid channels 213*b* are formed in the plurality of fluid channel members 50, and each of the respective individual fluid channels communicates with an opening portion (not shown) provided in the back surface of a corresponding one of the element substrates 10.

The negative pressure control units 230 indicated by H and L in FIG. 9B are a negative pressure control unit on a high-pressure side (H) and a negative pressure control unit on a low-pressure side (L). The respective negative pressure control units 230 are back pressure type pressure regulating mechanisms set so as to control pressures on the upstream sides of the negative pressure control units 230 with relatively high (H) and low (L) negative pressures. The common supply fluid channel 211 is connected to the negative pressure control unit 230 (on the high-pressure side), and the common collection fluid channel 212 is connected to the negative pressure control unit 230 (on the low-pressure side), causing a pressure difference between the common supply fluid channel 211 and the common collection fluid channel 212. Owing to the pressure difference, the liquid passes through the individual supply fluid channels 213*a*, respective ink orifices (not shown) in the element substrates 10, and the individual collection fluid channels 213*b* in that order from the common supply fluid channel 211 and flows to the common collection fluid channel 212.

As can be seen in the arrangement shown in FIG. 9A, the printhead 30 has a module arrangement formed by a plurality of units and members. As shown in FIG. 9C, individual modules are formed by the fluid channel members 50, the element substrates 10, and the flexible wiring substrates 40. In this embodiment, the element substrates 10 are directly connected to the fluid channel members 50. The common supply fluid channel 211 provided in the fluid channel member 60 is supplied with the fluid from a communication port 61A formed in its upper surface to the individual supply fluid channel 213*a* via an individual communication port 53 formed in the lower surface of the fluid channel member 50. Subsequently, the liquid is collected to the common collection fluid channel 212 via the individual collection fluid channel 213*b*, the individual communication port 53, and the communication port 61A in that order through a pressure chamber (not shown) of the element substrate 10.

Note that the individual communication port 53 in the lower surface of the fluid channel member 50 (a surface on the side of the fluid channel member 60) includes an opening portion sufficiently large with respect to the communication port 61A formed in the upper surface of the fluid channel member 50. With this arrangement, communication is performed reliably between the two fluid channel members 50 and 60 even if a positional shift occurs when the respective modules are mounted on the fluid channel member 60, improving a yield when a head is manufactured and reducing a cost.

Figure 10:
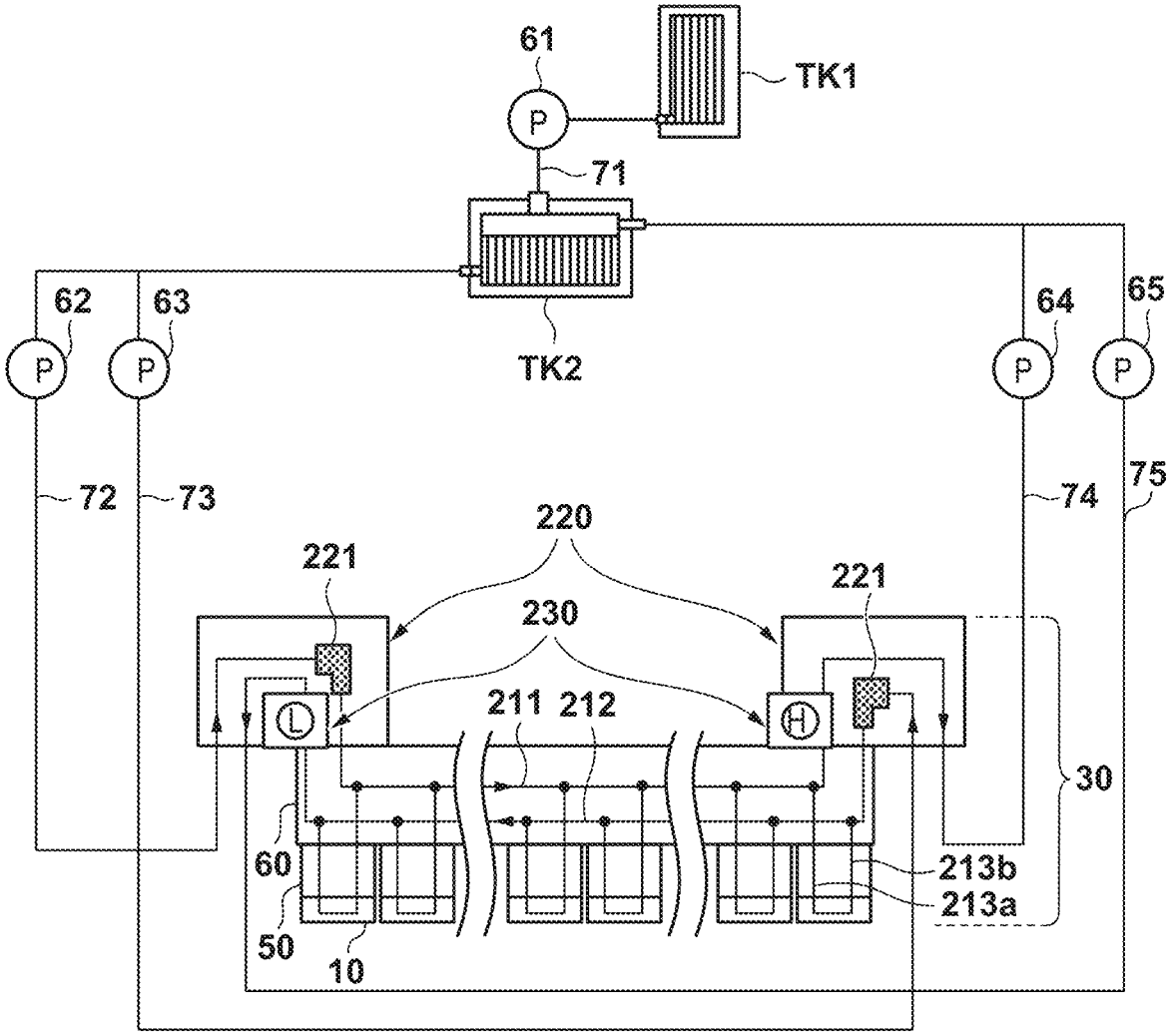
FIG. 10 is a view showing an ink circulation mechanism between the printhead and a buffer tank.
Figure 11A:
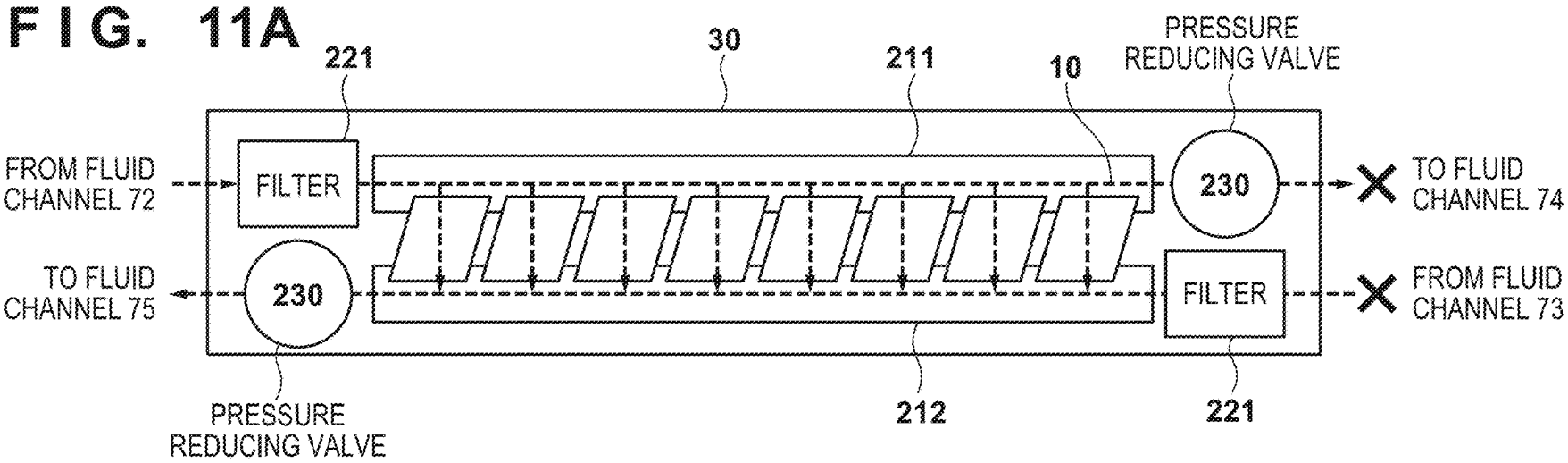
FIGS. 11A and 11B are views each for explaining an ink circulation direction in the printhead.
Figure 11B:
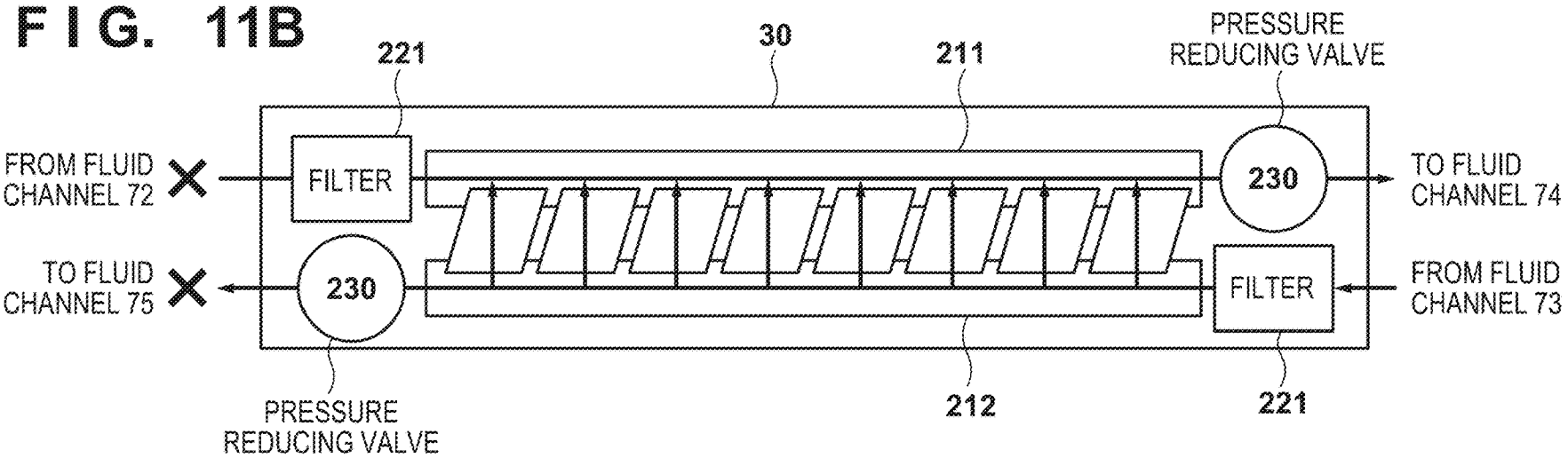

Ink Circulation Mechanism Between Printhead and Buffer Tank (FIGS. 10 to 11B)

FIG. 10 is a view showing an ink circulation mechanism between the printhead and a buffer tank. Note that the same reference numerals or symbols as those already described with reference to FIGS. 9A to 9C denote the same constituent elements in FIG. 10, and a description thereof will be omitted. Note that this ink circulation mechanism may be referred to as an ink supply apparatus.

As shown in FIG. 10, five pumps 61 to 65 are used for the ink supplying mechanism in this embodiment. In this embodiment, a reservoir TK that reserves ink is formed by a main tank TK1 and a buffer tank TK2, the buffer tank TK2 is connected to the printhead 30, and ink circulates between the buffer tank TK2 and the printhead 30. On the other hand, the pump 61 is provided in a fluid channel between the main tank TK1 and the buffer tank TK2. The pump 61 refills the buffer tank TK2 with the ink from the main tank TK1 appropriately.

The fluid channel 6*a* mentioned in FIG. 1 is formed by a fluid channel 71 between the main tank TK1 and the buffer tank TK2, and four fluid channels 72 to 75 between the buffer tank TK2 and the printhead 30, as shown in FIG. 10. Then, the pumps 62 to 65 are provided in the fluid channels 72 to 75, respectively.

In the ink circulation mechanism of this embodiment, it is possible to switch an ink circulation direction by controlling driving of the four pumps 62 to 65. That is, one circulation direction (first circulation channel) is a direction of circulating the ink in a direction (forward direction) of the common supply fluid channel 211→the individual supply fluid channels 213*a*→the respective nozzles of the element substrates 10→the individual collection fluid channels 213*b*→the common collection fluid channel 212 in the printhead 30. In this case, while the pump 62 and the pump 65 are driven, the pump 63 and the pump 64 are stopped.

The other circulation direction (second circulation channel) is a direction of circulating the ink in a direction (opposite direction) of the common collection fluid channel 212→the individual collection fluid channels 213*b*→the respective nozzles of the element substrates 10→the individual supply fluid channels 213*a*→the common supply fluid channel 211 in the printhead 30. In this case, while the pump 63 and the pump 64 are driven, the pump 62 and the pump 65 are stopped.

FIGS. 11A and 11B are views each for explaining an ink circulation direction in the printhead.

FIG. 11A shows an ink circulation in the forward direction. FIG. 11B shows an ink circulation in the opposite direction.

First, when the ink is circulated in the forward direction, the pump 62 and the pump 65 are driven, and the pump 63 and the pump 64 are stopped as described above. In this case, a pressure reducing valve operating as the negative pressure control unit 230 on the side of the fluid channel 74 is closed, and a pressure reducing valve operating as the negative pressure control unit 230 on the side of the fluid channel 75 is opened. Therefore, as shown in FIG. 11A, the ink passes through the filters 221 and reaches the common supply fluid channel 211 via the fluid channel 72, is supplied to the respective nozzles of the element substrates 10 via the individual supply fluid channels 213*a*, and returns from the common collection fluid channel 212 to the fluid channel 75 via the individual collection fluid channels 213*b* (first circulation state).

On the other hand, when the ink is circulated in the opposite direction, the pump 63 and the pump 64 are driven, and the pump 62 and the pump 65 are stopped as described above. In this case, the pressure reducing valve operating as the negative pressure control unit 230 on the side of the fluid channel 75 is closed, and the pressure reducing valve operating as the negative pressure control unit 230 on the side of the fluid channel 74 is opened. Therefore, as shown in FIG. 11B, the ink passes through the filters 221 and reaches the common collection fluid channel 212 via the fluid channel 73, enters the respective nozzles of the element substrates 10 via the individual collection fluid channels 213*b*, and returns from the common supply fluid channel 211 to the fluid channel 74 via the individual supply fluid channels 213*a* (second circulation state).

It is possible to change the ink circulation direction via the respective nozzles by thus controlling the driving of the four pumps 62 to 64 and opening/closing of the two pressure reducing valves operating as the negative pressure control units 230.

Figure 12:
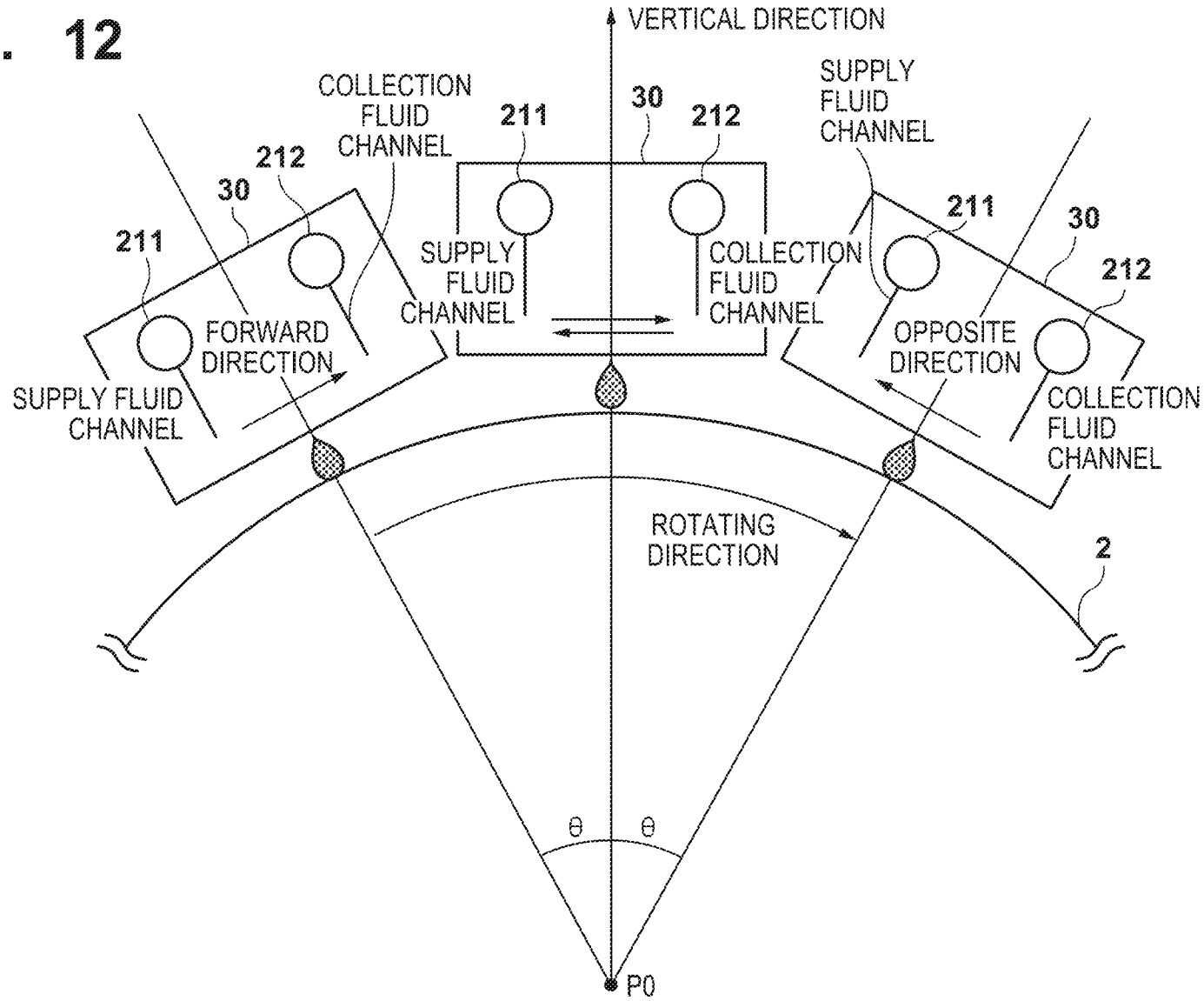
FIG. 12 is a view schematically showing a state of the plurality of printheads attached to the periphery of the transfer member.
Figure 13:
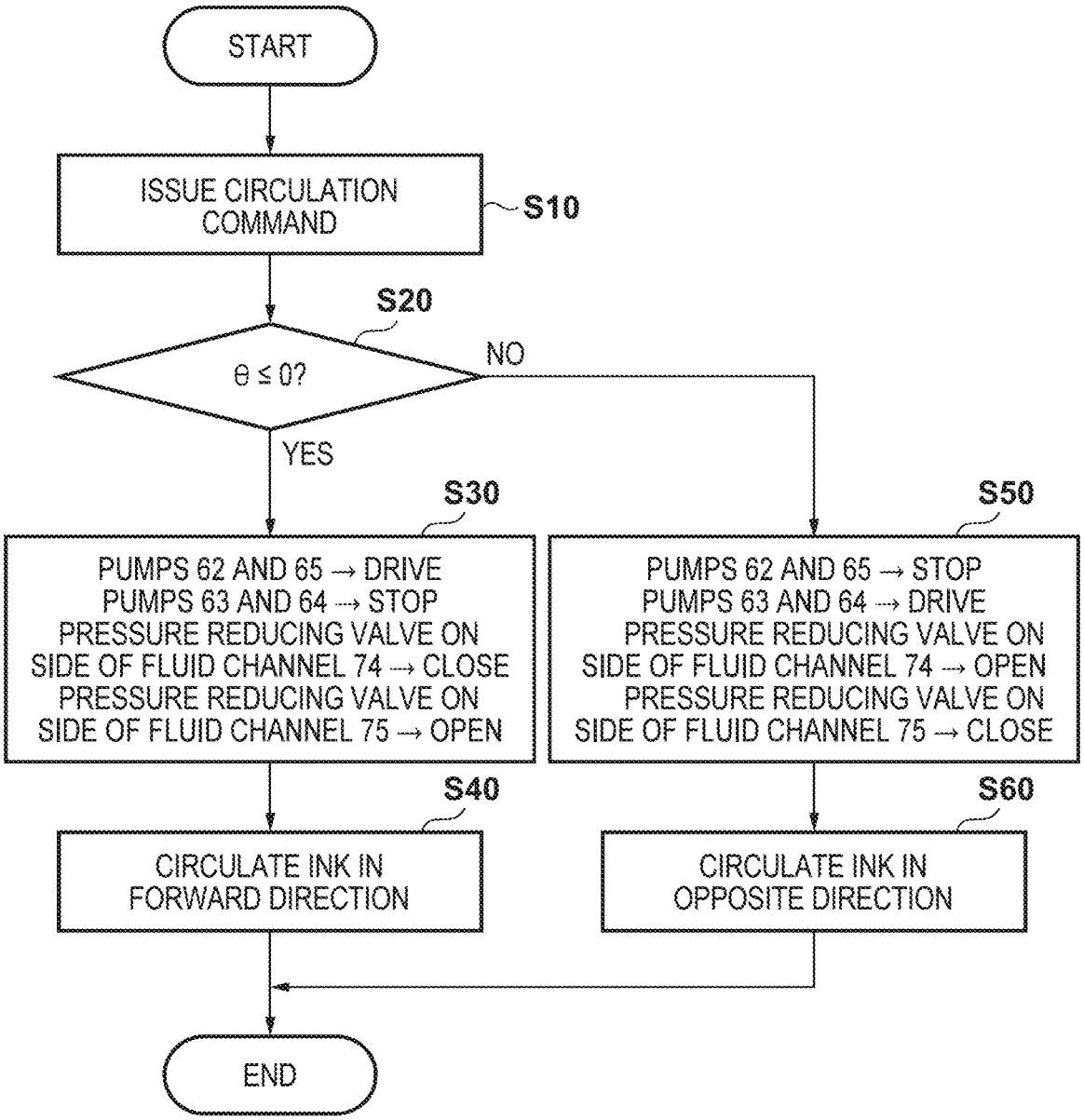
FIG. 13 is a flowchart showing ink circulation control.

Control of Ink Circulation Mechanism when Printhead is Mounted (FIGS. 12 and 13)

As described with reference to FIGS. 1 and 2, in this printing apparatus, the transfer member 2 is configured to move on a circular orbit cyclically, and thus the plurality of printheads 30 are arranged radially.

FIG. 12 is a view schematically showing a state of the plurality of printheads attached to the periphery of the transfer member.

As shown in FIG. 12, the three printheads 30 are attached to the periphery of the transfer member 2 radially. Viewing the three printheads individually, the printhead on the left side is attached such that an ink discharge direction tilts anticlockwise by an angle θ from a vertical direction, and the printhead on the right side is attached such that the ink discharge direction tilts clockwise by the angle θ from the vertical direction. On the other hand, the printhead at the center is attached such that the ink discharge direction becomes the vertical direction. This is because the printhead is attached such that the ink discharge direction becomes a normal direction of the transfer member regardless of an attachment position of the printhead. Note that P0 indicates the rotation center of the transfer member.

Therefore, in the printheads having the above-described arrangement, a fluid channel of ink flowing via the respective nozzles tilts in accordance with attachment positions of the respective printheads depending on a relative positional relationship between the common collection fluid channel 212 and the common supply fluid channel 211. In particular, when a printhead is attached to the print unit 3 or replaced for the first time, ink does not exist inside the printhead, and thus it is necessary to fill the inside of the printhead with the ink and remove an internal bubble before its use. Such bubble removal is also needed, for example, in a case in which the printing system is left stand without being operated for a long time at the time of a failure or the like, or in a case in which a bubble is formed in a nozzle by a change in ink component brought about by an environment change or the elapse of time.

The bubble moves upward because of its properties. Therefore, in this embodiment, the ink circulation direction inside the printhead is changed in accordance with the tilt of the attached printhead in order to remove the bubble more efficiently. This control is implemented by causing the printing control unit 15A to control driving of the respective pumps and pressure reducing valves in accordance with an attachment angle of each printhead.

That is, in the example shown in FIG. 12, while the printing control unit 15A controls driving of the pumps and opening/closing of the pressure reducing valves such that the ink circulates in the forward direction in the printhead on the left side, it controls driving of the pumps and opening/closing of the pressure reducing valves such that the ink circulates in the opposite direction in the printhead on the right side. The printhead at the center may select one of the forward direction and the opposite direction. If bubble removal is thus performed on the printheads attached with the tilt, an ink flow is controlled such that the ink flows above.

Furthermore, as can be seen in FIGS. 1 and 2, the nine printheads 30 are attached in this printing apparatus, and thus the tilts of the printheads are also different in accordance with their attachment positions. It is therefore possible, in accordance with their tilt angles, to change a suction force of a pump to be driven and perform bubble removal more efficiently. For example, as the tilt angles are smaller, it becomes possible to facilitate movement of a bubble by increasing the suction force of the pump and perform bubble removal more efficiently.

The above control is summarized as in the following flowchart.

FIG. 13 is a flowchart showing ink circulation control.

In step S10, in accordance with an instruction to, for example, attach or replace a printhead from the main controller 13A, or an instruction from the operation unit 133, a circulation command is issued. Next, in step S20, the attachment angle (θ) of the printhead corresponding to the command is obtained, and it is checked whether the angle is equal to or less than 0°. Note that θ=0 indicates the attachment angle of the printhead at the center shown in FIG. 12, θ>0 indicates the attachment angle of the printhead on the right side shown in FIG. 12, and θ<0 indicates the attachment angle of the printhead on the left side shown in FIG. 12. As can be seen in FIG. 2, if the attachment position of the printhead is known, it is possible to obtain an attachment angle at the position uniquely. θ<0 indicates that the common collection fluid channel 212 is located upward with respect to the common supply fluid channel 211 concerning the vertical direction. θ=0 indicates that the common collection fluid channel 212 and the common supply fluid channel 211 are located at the same position concerning the vertical direction. θ>0 indicates that the common collection fluid channel 212 is located downward with respect to the common supply fluid channel 211 concerning the vertical direction.

If θ≤0, the process advances to step S30. If θ>0, the process advances to step S50.

In step S30, the pumps 62 and 65 are driven, the pumps 63 and 64 are stopped, the pressure reducing valve on the side of the fluid channel 74 is closed, and the pressure reducing valve on the side of the fluid channel 75 is opened. Then, in step S40, ink is circulated in the forward direction inside the printhead. In contrast to this, in step S50, the pumps 63 and 64 are driven, the pumps 62 and 65 are stopped, the pressure reducing valve on the side of the fluid channel 74 is opened, and the pressure reducing valve on the side of the fluid channel 75 is closed. Then, in step S60, the ink is circulated in the opposite direction inside the printhead.

Therefore, according to the above-described embodiment, it is possible to remove the bubble more efficiently by changing the ink circulation direction in accordance with the attached angle of the printhead at the time of bubble removal from the printhead.

In the above embodiment, each printhead 30 has been described as a full-line printhead having a print width corresponding to the width of a print medium. However, the present invention is not limited to this. For example, the printhead 30 may be of a serial type that forms an ink image by discharging ink from the printhead 30 while moving a carriage to which the printhead 30 is detachably mounted in the Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-132262, filed Jul. 5, 2017, which is hereby incorporated by reference herein in its entirety.

What is claimed is:

1. An ink supplying apparatus comprising:

a printhead including a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly;

a tank configured to reserve the ink;

a circulation unit configured to circulate the ink in:

a first circulation direction in which the ink is circulated for supplying the ink from the tank to the plurality of print elements via the common supply fluid channel and the plurality of individual supply fluid channels, and collecting the ink from the plurality of print elements to the tank via the plurality of individual collection fluid channels and the common collection fluid channel or, a second circulation direction in which the ink is circulated for supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel; and a control unit configured to control the circulation unit to circulate the ink in the first circulation direction in a case where the printhead discharges the ink to form an image and to circulate the ink in the second circulation direction in a case where a printhead is attached to the ink supplying apparatus.

2. The apparatus according to claim 1, wherein the circulation unit circulates the ink in the first circulation direction by using a first circulation channel and circulates the ink in the second circulation direction by using a second circulation channel different from the first circulation channel, and the circulation unit includes:

a first pump provided between the tank and the common supply fluid channel in the first circulation channel;

a second pump provided between the common collection fluid channel and the tank in the first circulation channel;

a third pump provided between the tank and the common collection fluid channel in the second circulation channel; and a fourth pump provided between the common supply fluid channel and the tank in the second circulation channel.

3. The apparatus according to claim 2, further comprising a drive unit configured to drive the first pump and the second pump in a case where the first circulation channel is used, and drive the third pump and the fourth pump in a case where the second circulation channel is used in order to fill the connected printhead with the ink.

4. The apparatus according to claim 3, further comprising an instruction unit configured to instruct to perform driving by the drive unit in one of a case in which a printhead is attached, a case in which a printhead is replaced, and a case in which the connected printhead is left stand without being used for a long time.

5. The apparatus according to claim 2, wherein the printhead further includes:

a first valve provided in a first connection portion to be connected to the ink supplying apparatus in order to collect the ink to the tank by the first circulation channel; and a second valve provided in a second connection portion to be connected to the ink supplying apparatus in order to collect the ink to the tank by the second circulation channel.

6. The apparatus according to claim 5, wherein the control unit controls to close the second valve and open the first valve in a case where the circulation unit circulates the ink in the first circulation direction, and controls to open the second valve and close the first valve in a case where the circulation unit circulates the ink in the second circulation direction.

7. A printing apparatus comprising:

a printhead including a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly;

a transfer member on which an image is formed by ink discharged by the printhead;

a transfer unit configured to transfer, to a print medium, the image formed on the transfer member;

a tank configured to reserve the ink;

a circulation unit configured to circulate the ink in:

a first circulation direction in which the ink is circulated for supplying the ink from the tank to the plurality of print elements via the common supply fluid channel and the plurality of individual supply fluid channels, and collecting the ink from the plurality of print elements to the tank via the plurality of individual collection fluid channels and the common collection fluid channel, or a second circulation direction in which the ink is circulated for supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel; and a determination unit configured to determine whether to circulate the ink in the first circulation direction or the second circulation direction based on an attachment angle of the printhead to the transfer member.

8. The apparatus according to claim 7, wherein the transfer member is configured to move on a circular orbit cyclically, wherein the printhead is one of a plurality of printheads arranged radially around the transfer member so that the plurality of print elements face the transfer member, and wherein a positional relationship between the common supply fluid channel and the common collection fluid channel of each of the plurality of printheads differs in accordance with positions at which the plurality of printheads are attached.

9. The apparatus according to claim 8, wherein the determination unit determines to circulate the ink in the first circulation direction if the common collection fluid channel is located upward with respect to the common supply fluid channel in a direction of gravity and determines to circulate the ink in the second circulation direction if the common supply fluid channel is located upward with respect to the common collection fluid channel in the direction of gravity.

10. The apparatus according to claim 7, wherein determination by the determination unit is performed for each of the plurality of printheads.

11. The apparatus according to claim 7, wherein the printhead is a full-line printhead whose print elements are arranged in an area corresponding to a width of the transfer member.

12. The apparatus according to claim 7, wherein the determination unit determines in a case where a printhead is attached to the printing apparatus.

13. The apparatus according to claim 7, further comprising a control unit configured to circulate the ink in the first circulation direction regardless of the attachment angle in a case where the printhead discharges the ink to form an image.

14. An ink supplying method in an ink supplying apparatus including a printhead which includes a plurality of print elements configured to discharge ink, a plurality of individual supply fluid channels configured to supply the ink to the plurality of print elements, respectively, a common supply fluid channel configured to communicate with the plurality of individual supply fluid channels commonly, a plurality of individual collection fluid channels configured to collect the ink supplied to the plurality of print elements from the plurality of print elements, respectively, and a common collection fluid channel configured to communicate with the plurality of individual collection fluid channels commonly, the method comprising:

circulating the ink in a first circulation direction in which the ink is circulated for supplying the ink from a tank configured to reserve the ink to the plurality of print elements via the common supply fluid channel and the plurality of individual supply fluid channels, and collecting the ink from the plurality of print elements to the tank via the plurality of individual collection fluid channels and the common collection fluid channel in a case where the printhead discharges the ink to form an image; and circulating the ink in a second circulation direction in which the ink is circulated for supplying the ink from the tank to the plurality of print elements via the common collection fluid channel and the plurality of individual collection fluid channels, and collecting the ink from the plurality of print elements to the tank via the plurality of individual supply fluid channels and the common supply fluid channel in a case where a printhead is attached to the ink supplying apparatus.

* * * * *